United States Patent [19]

Hemsath

[11] Patent Number: 4,830,610

[45] Date of Patent: May 16, 1989

[54] HIGH TEMPERATURE CONVECTION FURNACE

[75] Inventor: Klaus H. Hemsath, Toledo, Ohio

[73] Assignee: Columbia Gas Service System Corporation, Columbus, Ohio

[21] Appl. No.: 212,693

[22] Filed: Jun. 15, 1988

Related U.S. Application Data

[63] Continuation of Ser. No. 865,839, May 21, 1986.

[51] Int. Cl.[4] ..... F27B 3/22

[52] U.S. Cl. ..... 432/146; 432/175; 432/176; 432/152

[58] Field of Search ..... 432/152, 148, 159, 172, 432/175, 176, 199, 146

[56] References Cited

U.S. PATENT DOCUMENTS

| | | | |
|---|---|---|---|
| 2,215,081 | 9/1940 | Hess . | |
| 2,225,166 | 12/1940 | Erby | 432/148 |
| 2,309,700 | 2/1943 | Huff | 432/206 |
| 2,456,469 | 12/1948 | Thomas et al. . | |
| 2,972,474 | 2/1961 | Von Linde et al. | 432/209 |
| 2,998,967 | 9/1961 | Dailey, Jr. et al. . | |
| 3,019,006 | 1/1962 | Lillienberg | 432/209 |
| 3,025,044 | 3/1962 | Giles | 432/209 |
| 3,053,523 | 9/1962 | Shipley . | |
| 3,091,445 | 5/1963 | Toney | 432/176 |
| 3,198,503 | 8/1965 | Eichelberg et al. | 432/199 |
| 3,199,854 | 8/1965 | Ipsen | 432/209 |
| 3,224,747 | 12/1965 | Bernard . | |
| 3,284,074 | 11/1966 | Kotatko et al. . | |
| 3,304,071 | 2/1967 | Gentry | 432/176 |
| 3,540,710 | 11/1970 | Yamagishi et al. | 432/209 |
| 3,708,156 | 1/1973 | Leland . | |
| 4,012,190 | 3/1977 | Dicks et al. | 432/146 |
| 4,278,421 | 7/1981 | Limgue et al. | 432/152 |
| 4,493,641 | 1/1985 | Hubbert | 432/176 |
| 4,527,974 | 7/1985 | Carraroli et al. | 432/176 |
| 4,527,974 | 7/1985 | Carraroli et al. | 432/176 |
| 4,722,683 | 2/1988 | Royer | 432/176 |
| 4,787,844 | 11/1988 | Hemsath | 432/205 |
| 4,789,333 | 12/1988 | Hemsath | 432/176 |

*Primary Examiner*—Henry C. Yuen
*Attorney, Agent, or Firm*—Harold F. Mensing

[57] ABSTRACT

A fuel fired heat treating furnace having an imperforate inner shell for containing a work load in isolation. The shell is made of a refractory material which provides a good heat exchange from the outside to the inside. A multiplicity of hot gas streams is directed under pressure against the outside of the shell by means of a circulation system which includes a plenum, a fan within the plenum and a plurality of apertured distributor tubes extending from one end of the shell to the other. Fuel burners exhaust combustion gases into the system on the discharge side of the fan where the gases mix with returning gases from the intake side of the fan and are fed into the distributor tubes.

18 Claims, 3 Drawing Sheets

HIGH TEMPERATURE CONVECTION FURNACE

This is a continuation of application Ser. No. 865,839, filed May 21, 1986.

SUMMARY OF THE INVENTION

This invention relates to a fuel fired industrial heat treating furnace having an imperforate heat exchange shell made of refractory material for containing a work load to be heated. More specifically it relates to such a furnace having a hot combustion gas circulating system which transfers heat at a high rate from the combustion gases uniformly to the outside of the shell. The furnace has an outer housing which surrounds the heat exchange shell and is spaced therefrom. A multiplicity of hot gas streams is directed against the outside of the shell by means of a plurality of apertured distribution tubes disposed in the space between the housing and shell. The tubes are spaced laterally from one another to provide exits for the spent gases in close proximity to the locations where the gas streams impinge on the shell. Hot combustion gases are mixed with a returned portion of the spent gases and fed into the tubes by means of a fan housed in a plenum. Fuel fired burners exhaust hot combustion gases into the circulation system on the discharge side of the fan.

DETAILED DESCRIPTION OF THE INVENTION

Figure 1:
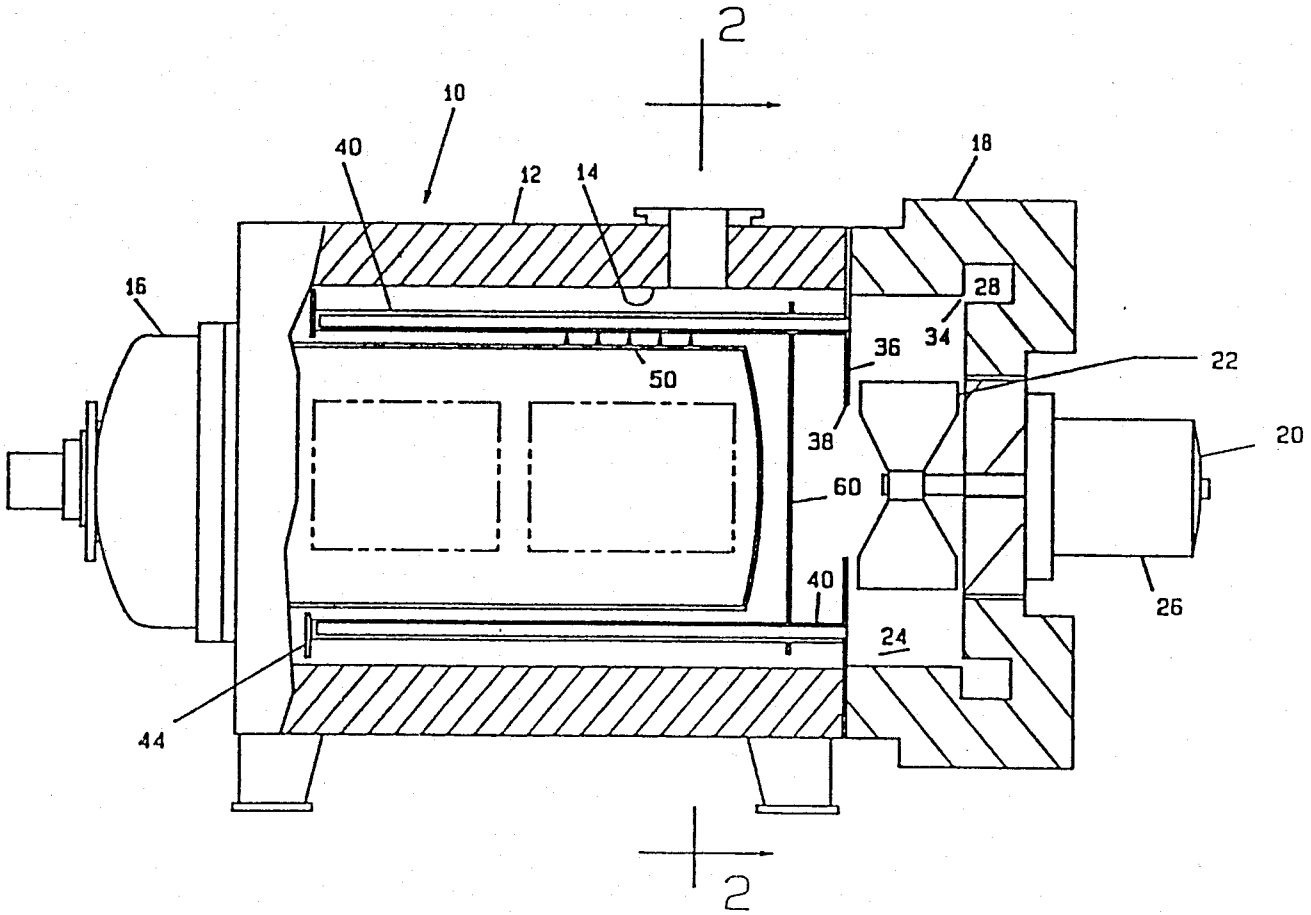
FIG. 1 is a side view of an embodiment with portions broken away to show interior details.
Figure 3:
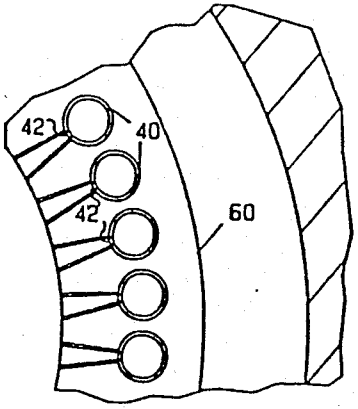
FIG. 3 is an enlarged broken away section of FIG. 2 showing the jet streams and jet apertures.
Figure 4:
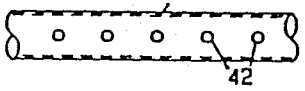
FIG. 4 is an enlarged radial view of a broken away section of a distributor tube taken from the jet aperture side.
Figure 2:
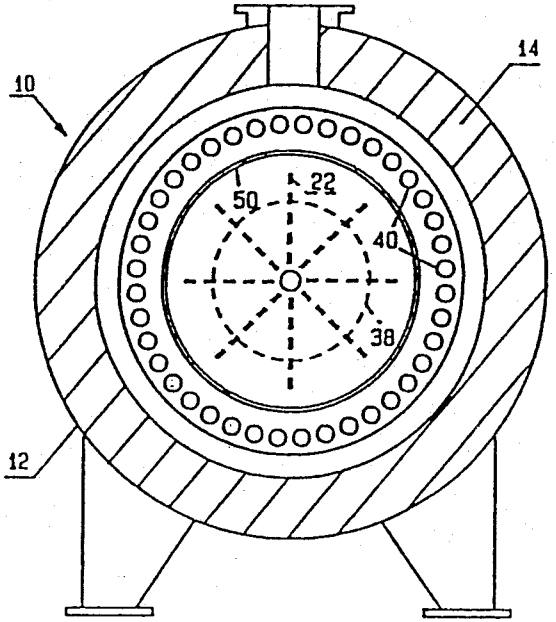
FIG. 2 is a sectional view taken along lines 2—2 of FIG. 1.
Figure 5:
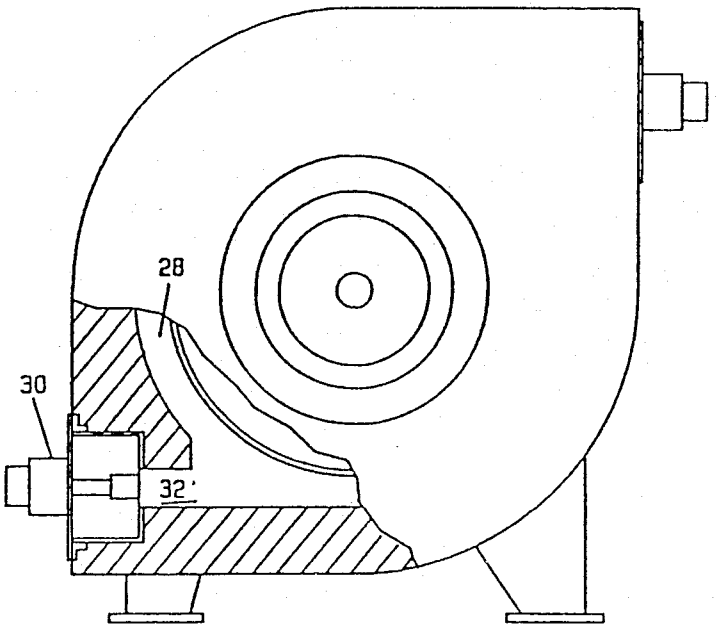
FIG. 5 is a view of one end of the furnace with portions broken away to show burner chamber details.

The high temperature convection furnace embodiment illustrated in the drawings is a batch type furnace 10 having a generally cylindrical outer housing 12 lined with insulation and refractory material 14 and constructed in accordance with normal practices. It is to be understood that the teachings of this invention may be applied also to furnaces in which workpieces to be heat treated are conveyed through the furnace in a continuous manner. A hinged access door 16 is provided at the front end of the housing. The rear end 18 of the furnace contains the means 20 for generating and circulating hot combustion gases.

The aforementioned means 20 comprises a paddle bladed radial flow fan 22 contained in a cylindrical plenum 24 and driven by an electrical motor 26. An annular burner chamber 28 having a rectangular cross section is located at the rear edge of the plenum periphery. A pair of burners 30 contained in the outside ends of tangentially disposed burner channels 32 produce hot combustion gases and cause them to swirl around the annular burner chamber 28. These hot combustion gases are exhausted into the plenum 24 through an annular slot 34 in the front wall of the burner chamber 28 adjacent to its inner circumference. The hot gases flow forwardly along the peripheral wall of the plenum 24 and are mixed with cooler or spent gases returning from the body of the furnace. Since the hot gases are introduced into the plenum on the discharge side of the fan they do not come into direct contact with the fan itself.

The forward side of the plenum 24 is defined by a flat annular plate 36 having a circular central intake opening 38 concentric with the fan but of smaller diameter. The input ends of a plurality of elongated distributor tubes 40 are mounted in a circle at equally spaced intervals around the outer portion of the annular plate 36 between the fan 22 and the periphery of the plenum 24. The distributor tubes 40 extend forwardly from the plenum to the front end of the furnace and are symmetrically arranged so their centerlines lie in a cylindrical pattern. Each of the distributor tubes is closed at its forward end and has a series of small radially disposed apertures or jets 42 facing towards the center of the furnace body. The forward ends of the tubes are affixed to an annular support plate 44 which is slidably contained on the inside of the refractory lining. It is important to space the tubes laterally from one another such that the total open area of the spaces between them exceeds the total open area of all of their jet apertures.

An inner casing or cylindrical shell 50 for isolating a work load from the combustion gases is concentrically disposed inside the ring of distributor tubes 40. It has an open forward end and a closed rearward end. Shell 50 is made of a refractory material, such as stainless steel, capable of rapidly absorbing heat and transferring it from its outside surface to its inside surface. The outside diameter of the casing is selected so as to be spaced from the surrounding distributor tubes a distance that is greater than the distance between individual tubes and less than the distance between the tubes and the inside surface of the refractory wall 14 of the outer housing 12. The key distance in this relationship is the distance between the jet apertures and the confronting portion of the shell surface. This distance is related to the size of the jet apertures. For example, if the jet apertures having a three-eights inch diameter opening were used, the preferred distance would be approximately three inches.

A refractory baffle plate 60 located in a space between the end wall of the shell 50 and the annular plenum plate 36 blocks the direct return flow of the spent gases from the body of the furnace into the intake opening of the plenum. Baffle plate 60 extends transversely across the body of the furnace from its center to a circumference slightly beyond the outermost surfaces of the distributor tubes leaving a small annular opening between the periphery of plate 60 and the surrounding refractory for the flow of spent gases out of the body of the furnace. The total area of this annular opening is larger than the total open area of all of the jet apertures.

FLOW PATTERN

The circulation of gases in the furnace begins at the burners where the hot combustion gases are produced. They flow from the burners into the annular combustion chamber 28 where they are swirled into the plenum chamber 24 through an annular slot. Once in the plenum they become dynamically mixed with returned or spent gases discharged radially from the fan. They travel transversely to the opposite side of the plenum where they are introduced under pressure to the open ends of the distributor tubes. The gases flow axially inside the tubes towards the opposite ends until they emerge from the jet apertures in a radially inward direction towards the outer surface of inner shell 50. At the surface of the shell each jet stream splits and then flows in a countercurrent direction away from the shell until the split streams exit the inner area through the spaces on either side of its respective tube. The spent gases then flow rearwardly in the annular area between the refractory lining and the cylindrical array of tubes. Ultimately they flow out of the body of the furnace through the annular opening defined by the periphery of baffle plate 60 and the surrounding refractory lining. On the last leg the gases flow radially inward on the rear side of the baffle plate until they are forced into the fan intake 38 by negative pressure in the plenum.

While this invention has been described with respect to its best mode and only one example has been illustrated in the drawings, it is to be understood that its scope is not limited solely to the described example but is defined primarily by the following claims.

What is claimed is:

1. An industrial heat treating furnace comprising: an outer housing having a refractory lining, an imperforate heat exchange shell within said housing, said shell being spaced inwardly from said housing lining, and a means for heating said shell uniformly, said means including a circular plenum section having a centrally disposed inlet and a peripheral inner surface, a circulating fan at said inlet, said fan having a periphery spaced inwardly from said peripheral inner surface, burner means for producing hot combustion gases, means for introducing said hot combustion gases into said space between said fan periphery and said peripheral inner surface, a plurality of hot combustion gas distributor tubes arranged symmetrically side-by-side around said shell in a spaced relationship with respect to each other and to said lining and to said shell, said tubes having a plurality of jet stream apertures, said tubes each having an end opening into said plenum in said space between said fan periphery and said inner peripheral surface of said plenum.

2. An industrial heat treating furnace according to claim 1 wherein the axes of the jet stream apertures are disposed normal to the confronting surface portion of said shell.

3. An industrial heat treating furnace according to claim 1 wherein the outer surface of the shell and the inner surface of the refractory lining are both cylindrical in form and the axes of said gas streams are radially disposed.

4. An industrial heat treating furnace according to claim 1 wherein the distance between the distributor tubes and the inner shell is less than the distance between the distributor tubes and the refractory lining but greater than the distance between adjoining tubes.

5. An industrial heat treating furnace according to claim 1 wherein the total open area of all of the space between the tubes is greater than the total open area of all of the hot gas stream apertures.

6. An industrial heat treating furnace comprising: a outer housing having a refractory lining, an imperforate heat exchange shell within said housing, said shell being spaced inwardly from the inner surface of said housing lining, a plurality of apertured hot gas distributor tubes for directing a multiplicity of hot gas streams towards said shell, said tubes being arranged symmetrically, side by side around said shell in a spaced relationship with respect to each other and to said lining and to said shell, and means for supplying hot combustion gases under pressure to said tubes, said furnace is a batch type furnace having two opposite ends with a hinged access door at one end and has a means for generating and circulating hot combustion gases at the other end.

7. An industrial heat treating furnace according to claim 6 wherein said means includes a radial flow fan contained in a cylindrical plenum and said hot combustion gases flow into said plenum through an annular slot on the discharge side of said fan adjacent to the plenum periphery.

8. An industrial heat treating furnace of the batch type comprising: an outer housing having two opposite ends with a hinged access door at one end, a means for generating and circulating hot combustion gases at the other end, a refractory lining on the inside of said housing, an imperforate heat exchange shell within said housing, said shell being spaced inwardly from the inner surface of said housing lining, a means for directing a multiplicity of hot combustion gas streams towards said shell, said directing means having a plurality of hot combustion gas distributor tubes arranged symmetrically, side by side around said shell in a spaced relationship with respect to each other and to said lining and to said shell, said tubes having a plurality of jet stream apertures, said generating and circulating means includes a means for supplying hot combustion gases to said tubes, said supplying means has a radial flow fan contained in a cylindrical plenum, said hot combustion gases flow into said plenum through an annular slot on the discharge side of said fan adjacent to the plenum periphery, said distributor tubes are mounted in an annular plate which forms a side wall of said plenum and said tubes have open ends communicating with the interior of said plenum adjacent to its periphery.

9. An industrial heat treating furnace comprising: an outer housing having a refractory lining, an imperforate heat exchange shell within said housing, said shell being spaced inwardly from the inner surface of said housing lining, a means for directing a multiplicity of hot combustion gas streams towards said shell, said means having a plurality of hot combustion gas distributor tubes arranged symmetrically, side by side around said shell in a spaced relationship with respect to each other and to said lining and to said shell, said tubes having a plurality of jet stream apertures with the axes of said apertures being disposed normal to the confronting surface portion of said shell, and means for supplying hot combustion gases under pressure to said tubes, said means for supplying hot combustion gases includes a fan, a plenum chamber, a burner means for producing said gases and exhausting them into said plenum chamber on the discharge side of a fan such that said gases flow under pressure into said distributor tubes where they emerge as jet streams from said apertures, then split and reverse flow direction exiting the area between said tubes and shell laterally through the spaces between the tubes, then axially along the outside of the array of tubes in the area between said array and said refractory lining and finally back into said fan.

10. An industrial heat treating furnace comprising: an outer housing having a refractory lining, an imperforate heat exchange shell within said housing, said shell being spaced inwardly from the inner surface of said housing lining, a plurality of apertured hot gas distributor tubes for directing a multiplicity of hot gas streams towards said shell, said tubes being arranged symmetrically, side by side around said shell in a spaced relationship with respect to each other and to said lining and to said shell, and means for supplying hot combustion gases under pressure to said tubes, said furnace is separated by a baffle plate into a section containing said shell and a section containing said means for supplying hot combustion gases, and said baffle plate restricts the flow of fluid from the former to the latter to an open space defined by the baffle periphery and the surrounding refractory lining.

11. An industrial heat treating furnace according to claim 10 wherein the total open area of said peripheral space is greater than the total area of all of the hot gas stream apertures.

12. An industrial heat treating furnace comprising: an outer housing having a refractory lining forming a first furnace section containing an imperforate heat exchange shell spaced inwardly from said lining, a second furnace section containing a circulating fan housed in a plenum chamber attached to said first furnace section, a plurality of apertured distributor tubes disposed in a side-by-side array in said first section around the outside of said shell for directing a multiplicity of hot combustion gas jet streams against said shell, said tubes being in fluid communication with said plenum on the discharge side of said fan, said tubes being spaced from said shell, from said lining and from each other, means for supplying hot combustion gases to said plenum chamber on the discharge side of said fan, and a baffle plate separating said sections from each other, said baffle plate restricting fluid flow from said first section to said second section to a space surrounding its periphery.

13. An industrial heat treating furnace according to claim 12 wherein said fan is a radial flow fan, said plenum is circular and said hot combustion gases flow from said means into said plenum through a concentric annular slot on the discharge side of said fan.

14. An industrial heat treating furnace according to claim 12 wherein the distance between the distributor tubes and the outer surface of said shell is less than the distance between said refractory lining and said tubes but greater than the distance between said adjoining tubes.

15. An industrial heat treating furnace according to claim 12 wherein the total open area of all of the space between the tubes is greater than the total open area of all of the hot gas stream apertures.

16. An industrial heat treating furnace according to claim 12 wherein the axes of the jet stream apertures are disposed normal to the confronting surface portion of said shell.

17. An industrial heat treating furnace according to claim 12 wherein the outer surface of the shell and the inner surface of the refractory lining are both cylindrical in form and the axes of said gas streams are radially disposed.

18. An industrial heat treating furnace according to claim 17 wherein said hot combustion gases are first exhausted into said plenum chamber on the discharge side of said fan, then flow under pressure into said distributor tubes where they emerge as jet streams from said apertures, then split and reverse flow direction exiting the area between said tubes and shell laterally through the spaces between said tubes, then axially along the outside of the array of tubes in the area between said array and said refractory lining and finally back into said fan.

* * * * *